US007825824B2

(12) United States Patent
Shrum, Jr.

(10) Patent No.: US 7,825,824 B2
(45) Date of Patent: Nov. 2, 2010

(54) COLLABORATIVE ENVIRONMENTAL REPORTING

(75) Inventor: Edgar Shrum, Jr., Smyrna, GA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 453 days.

(21) Appl. No.: 11/857,114

(22) Filed: Sep. 18, 2007

(65) Prior Publication Data

US 2009/0072997 A1 Mar. 19, 2009

(51) Int. Cl.
*G08G 1/00* (2006.01)

(52) U.S. Cl. ..... 340/902; 340/506; 340/601

(58) Field of Classification Search ..... 340/902, 340/933, 501, 506, 941, 540, 601, 603, 605, 340/903, 905–907, 910; 701/117, 1
See application file for complete search history.

(56) References Cited

U.S. PATENT DOCUMENTS 4,956,999 A * 9/1990 Bohannan et al. ..... 73/587
5,835,008 A * 11/1998 Colemere, Jr. ..... 340/439
6,643,578 B2 * 11/2003 Levine ..... 701/70
6,917,308 B2 * 7/2005 Hilliard ..... 340/940
7,085,637 B2 * 8/2006 Breed et al. ..... 701/38

* cited by examiner

*Primary Examiner*—Daniel Previl
(74) *Attorney, Agent, or Firm*—Hope Baldauff Hartman, LLC

(57) ABSTRACT

Methods, systems, and computer-readable media provide for the reporting of an environmental condition to vehicles prior to encountering the environmental condition. According to various embodiments described herein, local environment data corresponding to the environmental condition is collected from sensors on a vehicle. The local environment data is used to determine that the environmental condition exists at the current location of the vehicle. A notification that includes the geographic location of the environmental condition is created and provided to one or more other vehicles in the vicinity of the environmental condition.

15 Claims, 7 Drawing Sheets

COLLABORATIVE ENVIRONMENTAL REPORTING

TECHNICAL FIELD

This application relates generally to the field of environmental condition reporting. More specifically, the disclosure provided herein relates to providing real-time targeted environmental condition notifications to vehicle operators.

BACKGROUND

Millions of people operate vehicles on a daily basis on all types of roads and in all types of environmental conditions. Radio stations often employ traffic personnel to monitor traffic and to broadcast the current traffic and accident conditions to those drivers listening on a given radio frequency in their automobiles. The traffic personnel gather data from cameras mounted along the roadways, from other employees in helicopters or other vehicles monitoring the traffic conditions, and from people in traffic who call the traffic personnel to report current traffic conditions. However, these traffic reports rely on people to monitor and report current traffic conditions, rely on subjective human analysis, and utilize only traffic congestion reports and reports of current and past accidents, without providing any predictive environmental analysis that would alert motorists to potential hazards and prevent future accidents from occurring.

SUMMARY

It should be appreciated that this Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Methods, systems, and computer-readable media are provided herein for providing real-time reporting of environmental conditions to vehicle operators. According to embodiments described herein, local environment data corresponding to an environmental condition is collected from sensors on a vehicle. The sensors may monitor various systems on the vehicle as well as atmospheric conditions. The local environment data is used to determine that a particular environmental condition exists at the geographic location of the vehicle. A notification that includes the geographic location of the environmental condition is created and provided to at least one other vehicle in the vicinity of the environmental condition.

Other apparatus, systems, methods, and/or computer program products according to embodiments will be or become apparent to one with skill in the art upon review of the following drawings and Detailed Description. It is intended that all such additional apparatus, systems, methods, and/or computer program products be included within this description, be within the scope of the present invention, and be protected by the accompanying claims.

DETAILED DESCRIPTION

The following detailed description is directed to methods, systems, and computer-readable media for providing real-time environmental condition reports to vehicle operators. While the subject matter described herein is presented in the general context of program modules that execute in conjunction with the execution of an operating system and application programs on a computer system, those skilled in the art will recognize that other implementations may be performed in combination with other types of program modules.

Generally, program modules include routines, programs, components, data structures, and other types of structures that perform particular tasks or implement particular abstract data types. Moreover, those skilled in the art will appreciate that the subject matter described herein may be practiced with other computer system configurations, including hand-held devices, multiprocessor systems, microprocessor-based or programmable consumer electronics, minicomputers, mainframe computers, and the like.

The subject matter described herein may be practiced in a distributed computing environment where tasks are performed by remote processing devices that are linked through a communications network and wherein program modules may be located in both local and remote memory storage devices. It should be appreciated, however, that the implementations described herein may also be utilized in conjunction with stand-alone computer systems and other types of computing devices.

As discussed briefly above, current traffic reporting involves notifying motorists of a traffic accident and resulting area of traffic congestion. However, there are often environmental conditions that resulted in the accident that if reported early enough, could have prevented the accident from occurring in the first place. Embodiments of the disclosure provided herein allow for the continuous monitoring of environmental conditions using any number of sensors within vehicles as they travel. As hazardous environmental conditions are detected, notifications are sent to other vehicles that may encounter the same or similar environmental hazards. In this manner, accidents may be prevented rather than simply reported.

According to various embodiments, sensors within a vehicle monitor vehicle performance and environmental factors to determine whether a hazard or other environmental condition exists. Collected data is used to create a notification regarding the environmental hazard. The notification is then transmitted to other vehicles in the vicinity of the hazard in an effort to prevent an accident. Throughout this disclosure, embodiments are described with respect to reporting hazardous driving conditions to vehicle operators. However, it should be appreciated that this disclosure is equally applicable to the reporting of any environmental condition that may be detected in the manner described herein, whether hazardous or not.

Figure 1:
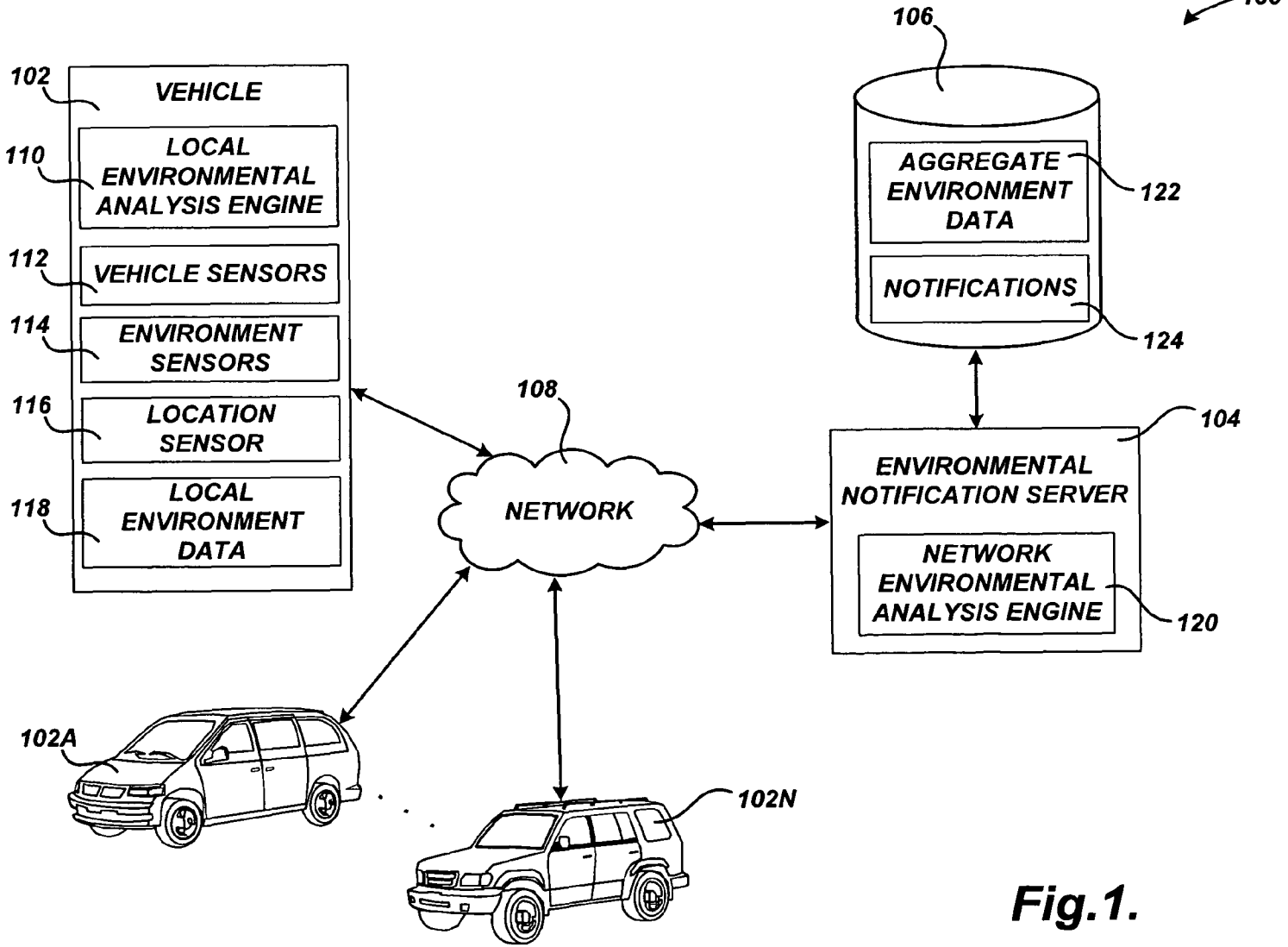
FIG. 1 is a block diagram showing elements of an illustrative environmental condition reporting system according to various embodiments presented herein.

In the following detailed description, references are made to the accompanying drawings that form a part hereof, and which are shown by way of illustration specific embodiments or examples. Referring now to the drawings, in which like numerals represent like elements through the several figures, aspects of an environmental hazard reporting system will be described. FIG. 1 shows various elements of the environmental conditions reporting system 100 according to embodiments described herein. The environmental conditions reporting system 100 includes a vehicle 102, an environmental conditions notification server 104, and an environmental notification database 106.

According to various embodiments, the vehicle 102 includes a local environmental analysis engine 110, vehicle sensors 112, environment sensors 114, a location sensor 116, and local environment data 118. The local environmental analysis engine 110 may include software and/or hardware and is operative to collect local environment data 118 from the vehicle sensors 112 and the environment sensors 114, and to utilize the local environment data 118 in the various manners described below. As will be described in detail below, the local environmental analysis engine 110 may be operative to transmit information regarding environmental hazards to other vehicles 102A-102N, and/or to operate in conjunction with a network environmental analysis engine 120 located on the environmental conditions notification server 104 to create and transmit notifications 124 regarding environmental hazards to the vehicles 102A-102N.

Figure 2:
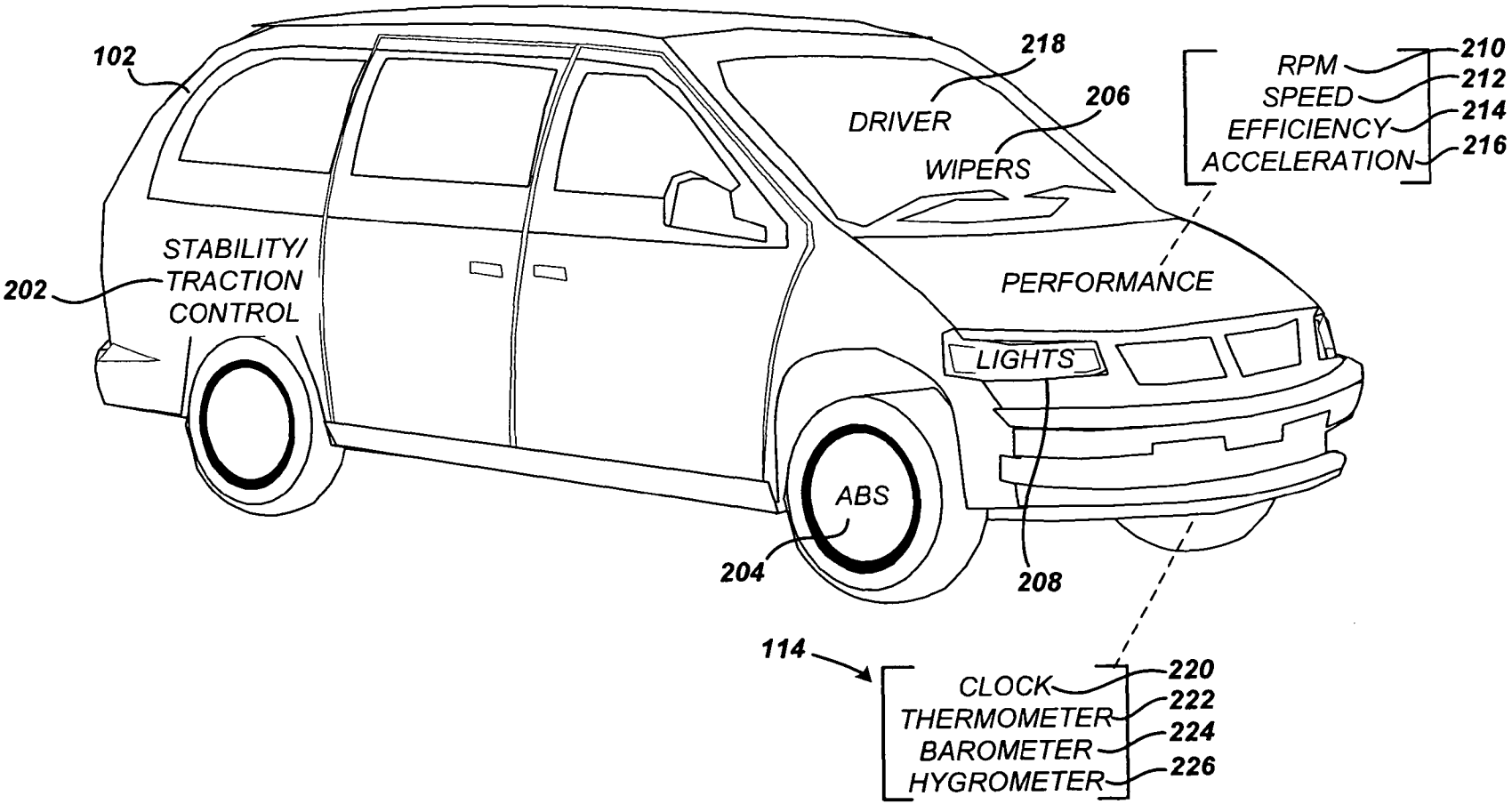
FIG. 2 is a pictorial diagram showing an illustrative example of vehicle and environmental sensors for providing input to the environmental condition reporting system of FIG. 1 according to various embodiments presented herein.

The vehicle sensors 112 include any type of monitoring and detection devices located on the vehicle 102 that are operative to monitor the performance of one or more vehicle systems and to communicate the results of the performance monitoring as local environment data 118. FIG. 2 shows examples of the vehicle sensors 112 according to various embodiments. The vehicle sensors 112 may include stability/traction control sensors 202. The stability/traction control sensors 202 may be a part of an electronic stability control system and/or traction control system on the vehicle 102. The electronic stability control system typically monitors the lateral acceleration, yaw, and individual wheel speeds of the vehicle 102 to provide braking and engine power modifications in an effort to assist a driver in maintaining control of the vehicle 102. Similarly, the traction control system typically senses drive-wheel slip and provides braking and engine power modifications to assist the driver in regaining control of the vehicle 102.

The stability/traction control sensors 202 determine when one or more wheels of the vehicle 102 lose traction and/or when the vehicle 102 loses control. This information is provided as local environment data 118 to the local environmental analysis engine 110, indicating a potentially hazardous environmental condition. It should be appreciated that the local environment data 118 from any of the vehicle sensors 112 or environment sensors 114 may be raw data relating to the performance or status of any particular component or system of the vehicle 102 or the environment, may be an analysis of the raw data, or any combination thereof. For example, the stability/traction control sensors 202 may store continuous quantities of raw data corresponding to the acceleration, vehicle yaw, and individual wheel speeds for a given period of time. This raw data may be the local environment data 118 that is then analyzed by the local environmental analysis engine 110 to determine when wheel slippage or loss of control occurs. Alternatively, the corresponding electronic stability control system and traction control system may monitor and analyze the raw data collected by the stability/traction control sensors 202 and provide local environment data 118 to the local environmental analysis engine 110 that represents a wheel slippage or loss of control has occurred.

The vehicle sensors 112 may also include anti-lock braking system (ABS) sensors 204 that determine when one or more of the wheels of the vehicle 102 is skidding. A typical ABS will utilize this data to alternately release and apply the brakes to the wheels at a rapid rate to prevent skidding and decrease the stopping distance of the vehicle 102. Data from the ABS sensors 204 may be used by the local environmental analysis engine 110 as local environment data 118 to determine that one or more wheels of the vehicle 102 are skidding, indicating a potentially hazardous environmental condition. The vehicle sensors 112 may also include windshield wiper sensors 206 that detect when the windshield wipers are activated, indicating rainy driving conditions and potentially reduced visibility. The windshield wiper sensors 206 may additionally detect moisture and activate the windshield wipers in response. Upon detecting moisture or the activation of the windshield wipers, the windshield wiper sensors 206 may create local environment data 118 that indicates to the local environmental analysis engine 110 that reduced visibility and wet driving conditions exist, creating a potential driving hazard.

The vehicle sensors 112 may additionally include vehicle light sensors 208 that detect when the vehicle lights are energized. In response, the vehicle light sensors 208 may create local environment data 118 that indicates to the local environmental analysis engine 110 that reduced visibility conditions are present that could create a driving hazard. The vehicle sensors 112 may also include various performance sensors such as a revolutions per minute (RPM) sensor 210, a vehicle speed sensor 212, an engine efficiency sensor 214, and an acceleration sensor 216. The performance sensors, as well as all other vehicle sensors 112, may individually create local environment data 118 or may create local environment data 118 in conjunction with one another.

For example, the RPM sensor 210 may receive data from the engine or from a vehicle tachometer that indicates engine RPMs. The vehicle speed sensor 212 may receive data from the wheels or from a vehicle speedometer that indicates vehicle speed. If the RPM sensor 210 detects a rapid increase in RPMs without any corresponding increase in speed from the vehicle speed sensor 212, then local environment data 118 may be created that indicates a wheel slippage condition that represents a hazardous driving condition. In this situation, each performance sensor may continuously store raw data that is monitored and interpreted by the local environmental analysis engine 110 to determine when a hazardous driving condition exists. The engine efficiency sensor 214 may detect the instantaneous fuel efficiency or any other type of performance efficiency indicator of the engine. Rapid and significant changes in the engine efficiency may indicate a rapid change in driving conditions. Coupled with local environment data 118 from other vehicle sensors 112 and environment sensors 114, this change in engine efficiency may indicate a hazardous driving condition.

Another performance sensor includes the acceleration sensor 216, or accelerometer. The acceleration sensor 216 is a device that detects and measures vehicle acceleration or deceleration. A sudden acceleration or deceleration, particularly when coupled with local environment data 118 from other vehicle sensors 112 and environment sensors 114, may indicate to the local environmental analysis engine 110 that the vehicle 102 has encountered a hazardous driving condition. Acceleration sensors 216 within the seatbelt systems of the vehicle 102, for example, might detect a sudden deceleration that would trigger the engagement of the seatbelts. This sudden deceleration may be stored as local environment data 118 that indicates a hazard that required a rapid application of the vehicle brakes.

There may additionally be any type and number of driver sensors 218 that detect various changes in the driver's physiological characteristics. For example, capacitance sensors in the steering wheel may measure the driver's heart rate. Sensors may track the driver's eye movement to detect sudden directional changes corresponding to the driver's line of sight, indicating a situation in which the driver suddenly looked one direction or another to view and avoid a particular hazard. Sensors in the driver's seat may detect shifts in the driver's weight resulting from a rapid directional change, acceleration, or deceleration of the vehicle 102.

In addition to the vehicle sensors 112, the vehicle 102 may include any type and number of environment sensors 114. The environment sensors 114 detect atmospheric and other ambient weather conditions outside of the vehicle 102, as well as any other information used to determine whether a potentially hazardous condition exists. For example, the environment sensors 114 may include a clock 220 for determining the time of day. This information may be useful to determine whether the lights on the vehicle 102 were turned on as a result of the sun setting, a relatively non-hazardous condition, or whether the lights were turned on during the daytime as a result of rain, fog, or other low-visibility purposes, a potentially hazardous condition. Other environment sensors may include a thermometer 222, barometer 224, and hygrometer 226, for measuring temperature, atmospheric pressure, and humidity, respectively.

The local environment data 118 from the vehicle sensors 112 and the environment sensors 114 may be combined to predict and detect driving hazards before an accident actually occurs. For example, if the vehicle 102 encounters a situation in which the local environment data 118 includes data from the stability/traction control sensors 202 that indicates tires of the vehicle 102 are spinning, data from the RPM sensor 210 and the vehicle speed sensor 212 that indicates that the engine RPMs are increasing rapidly with no change in vehicle speed, data from the thermometer 222 that the ambient temperature is 32 degrees, and data from the windshield wiper sensors 206 that moisture is present, then the local environmental analysis engine 110 may determine that the vehicle 102 has encountered a patch of ice on the road. According to the embodiments described below, the environmental conditions reporting system 100 may then transmit a notification to vehicles 102A-102N in the vicinity to warn the corresponding drivers of the hazardous condition at the location of the vehicle 102. It should be understood that the vehicle sensors 112 and environment sensors 114 shown in FIG. 2 are not all inclusive. Any number and type of vehicle sensors 112 and environment sensors 114 may be used by the environmental conditions reporting system 100 to determine when potentially hazardous driving conditions exist.

Returning now to FIG. 1, the vehicle 102 includes the location sensor 116. The location sensor 116 may include any device capable of determining the geographic location of the vehicle, either autonomously or in conjunction with one or more other network devices. The location sensor 116 may include a global positioning system (GPS) receiver for determining the position of the vehicle 102 utilizing signals from a network of satellites. Alternatively, the location sensor 116 may include a cellular telecommunications device that is used by the local environmental analysis engine 110 to transmit local environment data 118 to the environmental notification server 104 via a network 108. When the local environment data 118 is transmitted via the cellular telecommunications device, then the location of the vehicle 102 may be determined via triangulation of cellular signals or other known methods of determining the geographic location of a cellular transmission. The environmental conditions reporting system 100 utilizes the geographic location of the vehicle 102 as determined by the location sensor 116 in order to notify the vehicles 102A-102N of the location of the hazardous driving condition. It should be appreciated that each of the vehicles 102A-102N may include the components shown and described with respect to the vehicle 102.

The environmental notification server 104 includes the network environmental analysis engine 120. The network environmental analysis engine 120 may include software and/or hardware and is operative to collect local environment data 118 from the local environmental analysis engines 110 of the vehicles 102A-102N to create aggregate environment data 122. The network environmental analysis engine 120 analyzes the aggregate environment data 122 as described below and creates and transmits notifications 124 to warn the applicable vehicles 102A-102N of a potentially hazardous driving condition. An environmental notification database 106 is a repository for storing the aggregate environment data 122 and the notifications 124. The environmental notification database 106 may be connected directly or remotely to the environmental notification server 104 or may be a part of the environmental notification server 104.

The elements of the environmental conditions reporting system 100 communicate with one another via the network 108. It should be appreciated that the network 108 may include a wireless network such as, but not limited to, a Wireless Local Area Network (WLAN) such as a WI-FI network, a Wireless Wide Area Network (WWAN), a Wireless Personal Area Network (WPAN) such as BLUETOOTH, or a Wireless Metropolitan Area Network (WMAN) such a WiMAX network. According to embodiments described herein, the network 108 is a cellular network or a satellite network since communication needs to occur between vehicles 102A-102N and network elements that are likely geographically separated by large distances. The vehicles 102A-102N each include communications devices that are used by the local environmental analysis engine 110 to communicate with the network environmental analysis engine 120 at the environmental notification server 104. According to various embodiments, the communications devices are cellular or satellite transceivers.

Figure 3:
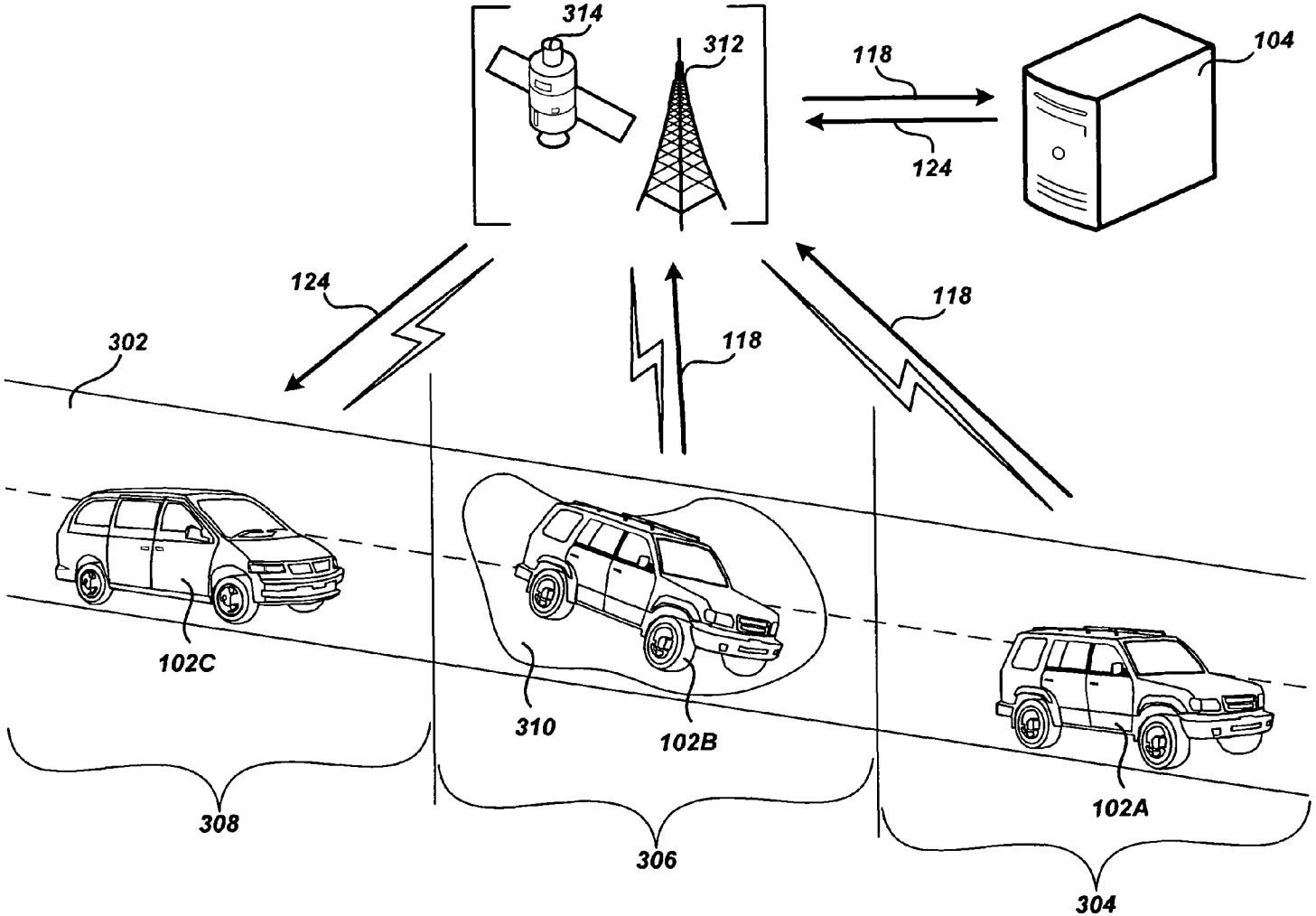
FIG. 3 is a pictorial diagram showing a first illustrative example of environmental condition reporting according to various embodiments presented herein.

Turning to FIG. 3, an illustrative example of environmental condition reporting utilizing the environmental conditions reporting system 100 according to various embodiments presented herein will be described. For simplicity, the example depicted in FIG. 3 shows three vehicles 102A, 102B, and 102C traveling in the same direction on a road 302. The road 302 has been divided into three road portions, 304, 306, and 308 for illustrative purposes. The road portion 306 includes a hazard 310 such as black ice. The vehicle 102A has successfully negotiated the hazard 310 and is currently on the road portion 304. The vehicle 102B is on the road portion 306 and is currently slipping on the hazard 310. The vehicle 102C is on the road portion 308 and has not yet encountered the hazard 310.

According to embodiments described herein, the vehicle 102A transmits local environment data 118 corresponding to the hazard 310 to the environmental notification server 104 via a cellular telecommunications system 312 or a satellite communications system 314. It should be appreciated that the vehicle 102A may be transmitting the local environment data 118 associated with the hazard 310 currently from the road portion 304, or may have transmitted the local environment data 118 substantially simultaneously from the road portion 306 as the hazard 310 was encountered. As discussed above, the local environment data 118 may be data from any of the vehicle sensors 112 and/or the environment sensors 114 that detected a condition that may be interpreted as contributing to the wheel slippage from the hazard 310. The local environment data 118 may alternatively be a notification to the environmental notification server 104 that the hazard 310 exists, as determined by the local environmental analysis engine 110 from the data collected by the vehicle sensors 112 and/or the environment sensors 114. The local environment data 118 transmitted from the vehicle 102A to the environmental notification server 104 should include the geographic location of the vehicle 102A at the time that the hazard 310 was encountered, as determined by the location sensor 116. Alternatively, the geographic location of the vehicle 102A may be determined from the cellular or satellite transmission from the vehicle 102A.

As the vehicle 102B encounters the hazard 310 on the road portion 306, the local environmental analysis engine 110 of the vehicle 102B detects the hazard and transmits applicable local environment data 118 to the environmental notification server 104 as described with respect to vehicle 102A. The network environmental analysis engine 120 receives the local environment data 118 from the vehicles 102A and 102B pertaining to the hazard 310 and determines whether a notification 124 should be created and transmitted to the vehicle 102C. According to one embodiment, the network environmental analysis engine 120 determines whether a threshold amount of aggregate environment data 122 exists prior to creating and transmitting the notification 124.

In the example shown in FIG. 3, the threshold amount of aggregate environment data 122 received prior to transmitting the notification 124 to the vehicle 102C may be the receipt of similar local environment data 118 from two different vehicles 102A and 102B. By requiring similar data, or data that supports a conclusion that the hazard 310 exists, from more than one vehicle 102, then inaccurate notifications 124 can be avoided. If the notification 124 was sent after only a single vehicle 102 reports a problem, then the notification 124 would be sent warning the vehicle 102C of potential ice or slippage hazard 310 even if the vehicle 102B merely lost traction momentarily due to driver error or recklessness. According to various embodiments, the threshold may be higher for roads that receive a high volume of traffic and lower for rural roads or roads that are not as well traveled.

According to further embodiments, the threshold may be different according to a subscription level associated with the receiving vehicle 102. For example, the driver of a large tractor trailer vehicle may subscribe to a notification service that allows the driver of the truck to receive notifications 124 after a low threshold amount of aggregate environment data 122 has been received by the network environmental analysis engine 120 due to the relatively poor handling of the truck coupled with the potential expense of the cargo. In contrast, the driver of a four wheel drive truck may subscribe to a notification service that limits the notifications 124 sent to the truck to only those that meet a higher threshold amount of aggregate environment data 122 due to the increased capabilities of the four wheel drive vehicle.

Once the threshold amount of aggregate environment data 122 exists, indicating the presence of the hazard 310, then the network environmental analysis engine 120 determines what type of notification 124 should be transmitted and how and where it should be transmitted. As will be discussed further below with respect to FIG. 6, the network environmental analysis engine 120 may transmit the notification 124 to all vehicles 102A-102N or to specific vehicles 102A-102C in the vicinity of the hazard 310; to electronic signs in the vicinity of the hazard 310; to the Department of Transportation (DOT) for placement on one or more signs or other traffic alert systems and for taking action such as dispatching a salt truck to an icy location; to one or more radio and/or television stations to be broadcast during traffic reports; and/or to police departments, fire departments, and other emergency agencies for broadcasting and for taking any appropriate action.

In the example shown in FIG. 3, the notification 124 is sent to the vehicle 102C since it is in the road portion 308 proximate to the hazard 310 and has not yet encountered the hazard 310. The notification 124 may be received by the local environmental analysis engine 110 within the vehicle 102C and displayed on a navigation system or other display screen within the vehicle 102C. Alternatively, the notification may be audibly presented to the driver of the vehicle 102C via the sound system speakers or a dedicated notification speaker. To transmit the notification 124 to the vehicle 102C, the network environmental analysis engine 120 may transmit over a specified radio frequency that is monitored by the local environmental analysis engine 110 within the vehicle 102C. Alternatively, the network environmental analysis engine 120 may determine the location of all vehicles 102 within a determined proximity to the hazard 310 from GPS data or other location detection means provided by all participating vehicles 102 and then transmit the notification 124 to those vehicles 102 using the cellular telecommunications system 312 or the satellite communications system 314.

Figure 4:
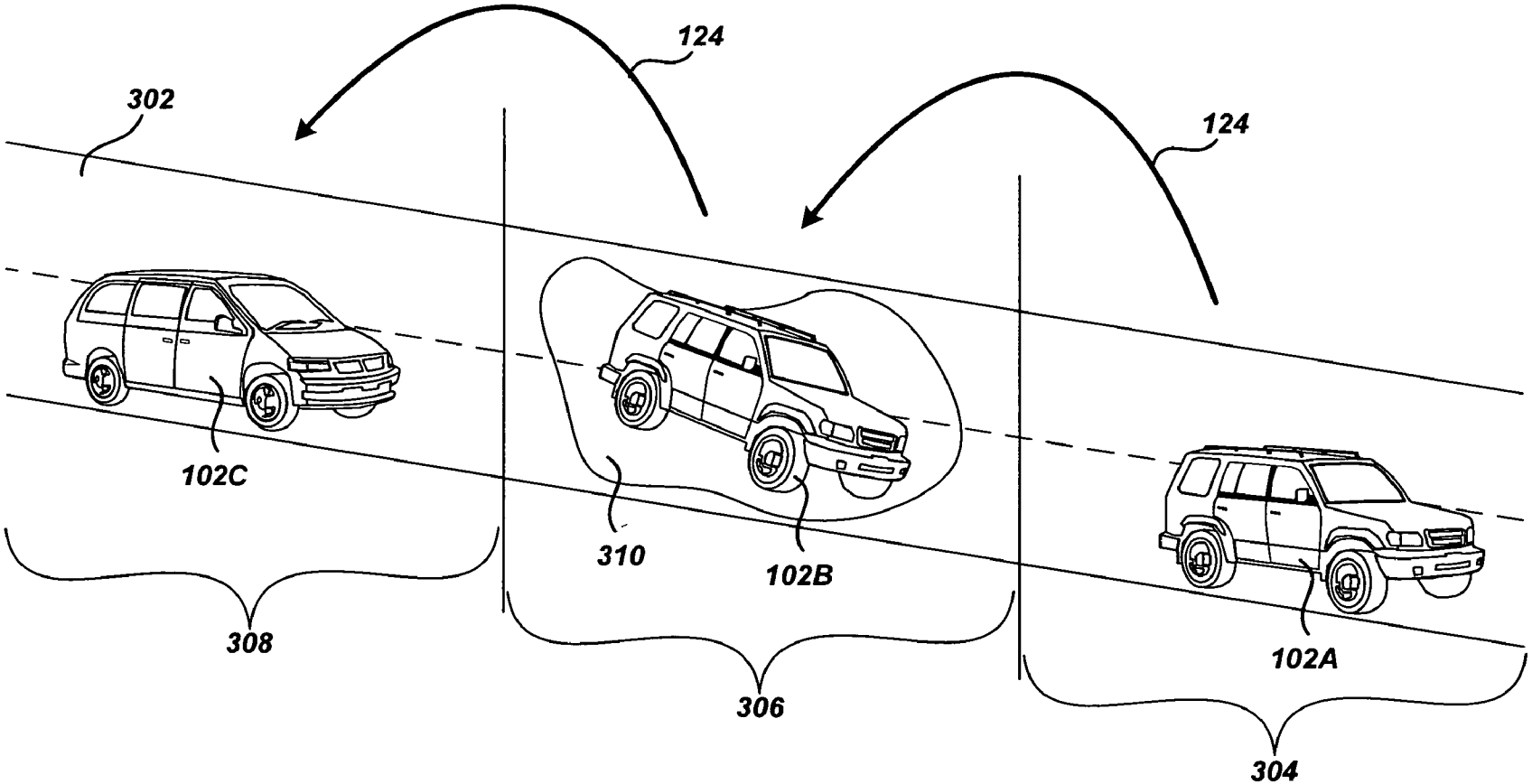
FIG. 4 is a pictorial diagram showing a second illustrative example of environmental condition reporting according to various embodiments presented herein.

FIG. 4 shows another example of environmental condition reporting utilizing the environmental conditions reporting system 100 according to another embodiment presented herein. In this example, the local environmental analysis engine 110 in each of the vehicles 102A, 102B, and 102C creates the notifications 124 and locally broadcasts them without the use of the environmental notification server 104. According to this embodiment, the lead vehicle 102A encounters the hazard 310 first. The vehicle sensors 112 and the environment sensors 114 record local environment data 118 as the vehicle 102A crosses the hazard 310 that is interpreted by the local environmental analysis engine 110 to indicate that the hazard 310 exists and the corresponding notification 124 should be created. The local environmental analysis engine 110 in the vehicle 102A creates the notification 124 and broadcasts the notification 124 over a specified frequency or via other known communication means over a short-range wireless network.

The local environmental analysis engine 110 within the vehicle 102B is monitoring for communications via the short-range wireless network and receives the notification 124 either before or after encountering the hazard 310. The hazard detection and notification process repeats in vehicle 102B. The vehicle 102C then receives the notification 124 from one or both of the vehicles 102A and 102B in time to avoid the hazard 310. It should be appreciated that the vehicle sensors 112 and the environmental sensors 114 within the vehicle 102C will not detect the hazard 310 since the driver of the vehicle 102C is able to avoid the hazard 310 due to the notification 124. However, upon receiving the notification 124, the vehicle 102C may broadcast the same notification 124 in order to continue the notification chain for the benefit of other vehicles 102 following the vehicle 102C.

Figure 5:
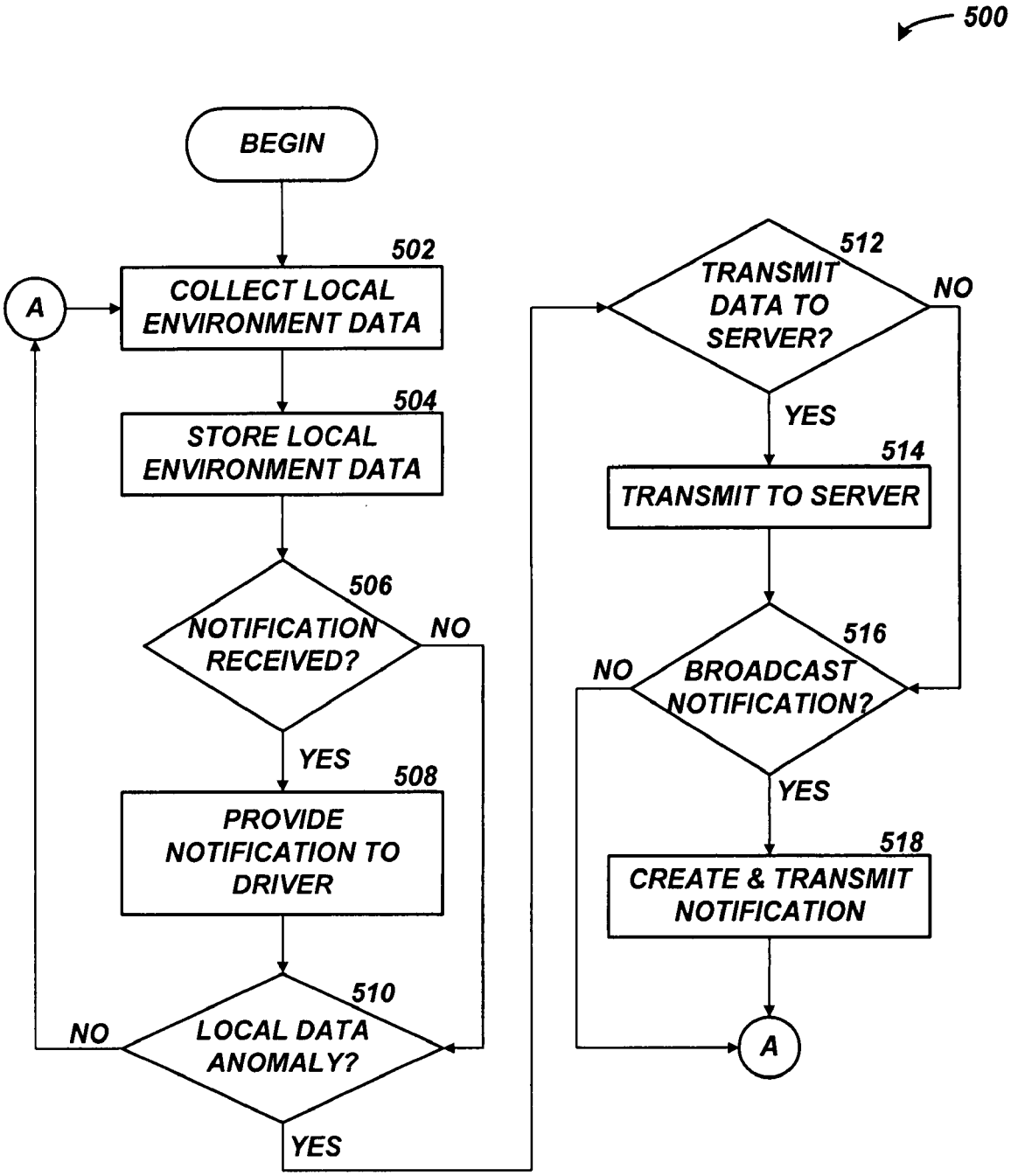
FIG. 5 is a flow diagram illustrating a method used by a local environmental analysis engine for providing environmental data according to various embodiments presented herein.

Turning now to FIG. 5, an illustrative routine 500 will be described for providing environmental data according to various embodiments presented herein. It should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance requirements of the computing system. Accordingly, the logical operations described herein are referred to variously as operations, structural devices, acts, or modules. These operations, structural devices, acts and modules may be implemented in software, in firmware, in special purpose digital logic, and any combination.

The routine 500 begins at operation 502, where the local environmental analysis engine 110 collects local environment data 118. As discussed above, this local environment data 118 may originate from any number and type of vehicle sensor 112 and/or environment sensor 114 located within the vehicle 102. At operation 504, the local environmental analysis engine 110 stores the local environment data 118. According to one embodiment, only a small amount of local environment data 118 is cached. As soon as the local environment data 118 is forwarded to the environmental notification server 104 or broadcast directly to other vehicles 102A-102N, the local environment data 118 is deleted. Doing so frees up storage space and reduces the cost associated with storing large quantities of data at the vehicle 102.

According to another embodiment, a large quantity of local environment data 118 is stored by the local environmental analysis engine 110. By doing so, the local environmental analysis engine 110 may analyze the stored local environment data 118 to determine if more than one instance of an environmental condition is occurring at the same geographic location at different times, allowing a corresponding notification 124 to be broadcast when it otherwise might not be. For example, assume the vehicle 102 encounters the environmental condition that triggers local environment data 118 to be stored, but does not trigger a report to the environmental notification server or a direct broadcast of the notification 124. As described above, thresholds may be set at the environmental notification server 104 that must be met before the network environmental analysis engine 120 broadcasts the notification 124.

Similarly, thresholds for the local environment data 118 may be set that must be met before the local environmental analysis engine 110 transmits the applicable local environment data 118 to the environmental notification server 104 or broadcasts the notification 124 directly to other vehicles 102. Doing so ensures that small anomalies in vehicle performance that are the result of a driver error rather than from an environmental condition or hazard are not reported to the environmental notification server 104 or broadcast to other vehicles 102. However, if a small anomaly exists every time the vehicle 102 passes a particular geographic location, the local environmental analysis engine 110 may deduce that the small anomaly is created from an environmental or road condition rather than from driver error. In these instances, the resulting local environment data 118 is forwarded to the environmental notification server 104 or broadcast as the notification 124 directly to other vehicles 102. These small repetitive anomalies may not be discovered without a large quantity of local environment data 118 stored at the vehicle 102.

Returning to FIG. 5, the routine 500 continues from operation 504 to operation 506, where the local environmental analysis engine 110 determines whether any notifications 124 were received from the network environmental analysis engine 120 or directly from another vehicle 102. If not, then the routine 500 proceeds to operation 510 and continues as described below. However, if at operation 506, the local environmental analysis engine 110 determines that one or more notifications 124 were received, then the routine 500 continues to operation 508, where the notification 124 is provided to the driver. As mentioned briefly above, the notification 124 may be displayed on a navigation system screen or other display screen within the vehicle 102, may be an audible notification played through the sound system of the vehicle 102 or through a separate speaker dedicated to environmental condition notifications, or a combination of visual and audible methods.

From operation 508, the routine 500 continues to operation 510, where the local environmental analysis engine 110 determines whether there is an anomaly in the local environment data 118. An anomaly may be any data that is abnormal with respect to the surrounding data. For example, a sudden jump in RPMs without any corresponding increase in vehicle speed is an anomaly that may indicate wheel slippage. If the local environmental analysis engine 110 does not detect an anomaly, then the routine returns to operation 502 and continues as described above. However, if at operation 510, the local environmental analysis engine 110 detects one or more anomalies in the local environment data 118, then the routine 500 proceeds to operation 512, where the local environmental analysis engine 110 determines whether the local environment data 118 is to be transmitted to the environmental notification server 104.

There may be situations in which the local environment data 118 is not to be sent to the environmental notification server 104. For example, as discussed above, there are situations in which an anomaly is detected, but some characteristics of the local environment data 118 do not satisfy a particular threshold. Additionally, when the local environmental analysis engine 110 is operative to create the notification 124 and directly broadcast it to other vehicles 102A-102N in the vicinity, then the local environmental analysis engine 110 will not transmit the local environment data 118 to the environmental notification server 104. Therefore, if the local environmental analysis engine 110 determines that the anomalous local environment data 118 is not to be transmitted to the environmental notification server 104, then the routine 500 proceeds from operation 512 to operation 516 and continues as described below. However, if at operation 512, the local environmental analysis engine 110 determines that the anomalous local environment data 118 should be transmitted to the environmental notification server 104, then the routine 500 continues to operation 514 and the local environment data 118 is transmitted.

From operation 514, the routine continues to operation 516, where the local environmental analysis engine 110 determines whether the notification 124 is to be created and broadcast to other vehicles 102A-102N in the vicinity over a short-range wireless network. If the local environmental analysis engine 110 determines that the notification 124 is not to be created and transmitted, then the routine 500 returns to operation 502 and the continues as described above. An example includes a situation in which an anomaly in the local environment data 118 was detected, but did not meet a required threshold for either transmission to the environmental notification server 104 or for local broadcasting. However, if at operation 516, the local environmental analysis engine 110 determines that the notification 124 is to be created and broadcast over a short-range network, then the routine 500 continues to operation 518 and the local environmental analysis engine 110 creates and transmits the notification 124. The routine 500 then returns to operation 502 and continues as described above.

Figure 6:
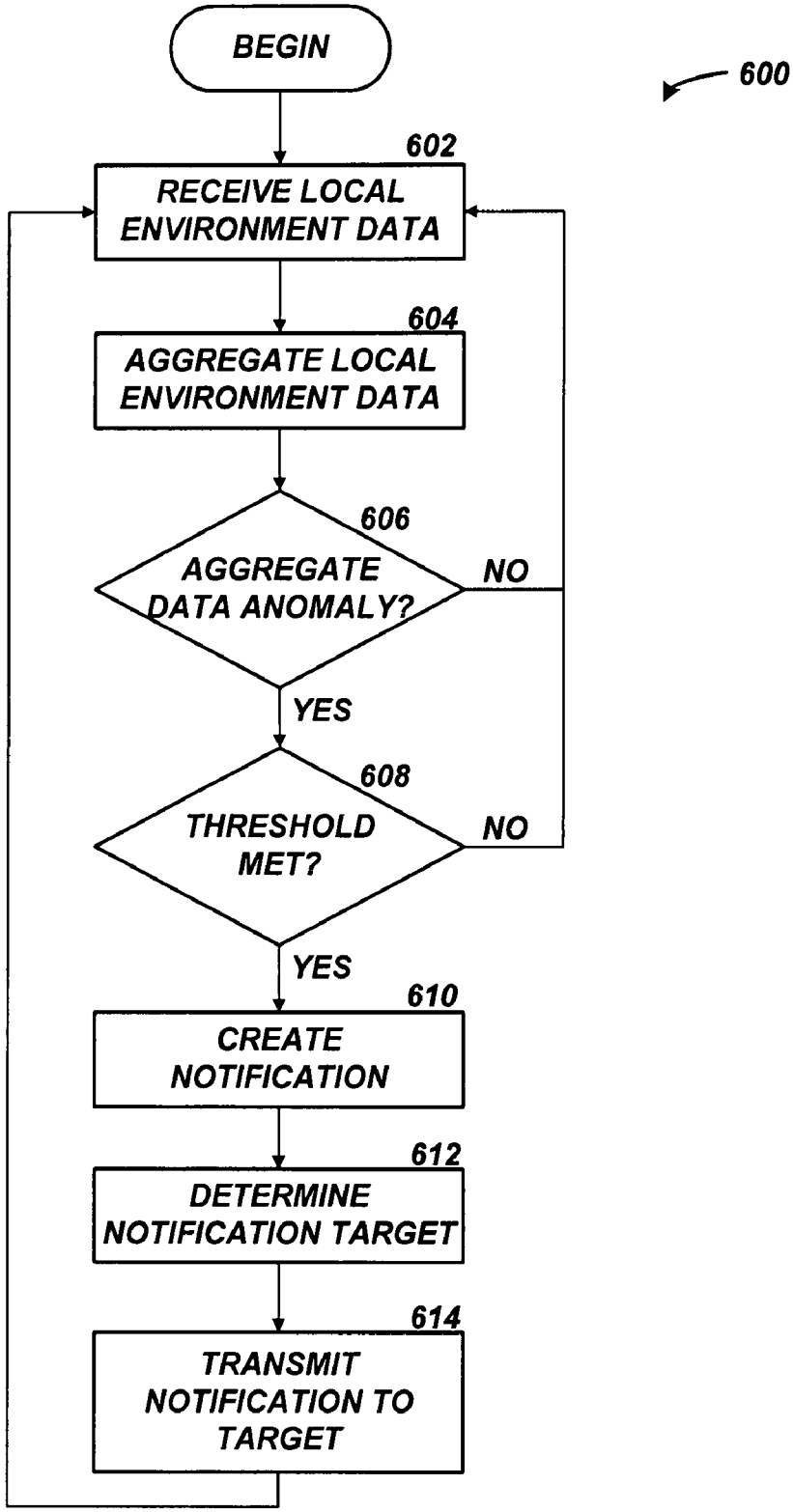
FIG. 6 is a flow diagram illustrating a method used by a network environmental analysis engine for providing environmental condition notifications according to various embodiments presented herein.

FIG. 6 shows an illustrative routine 600 for providing environmental condition notifications 124 according to various embodiments presented herein. The routine 600 begins at operation 602, where the network environmental analysis engine 120 receives local environment data 118 from the vehicle 102. At operation 604, the network environmental analysis engine 120 aggregates the local environment data 118 with other sets of local environment data 118 to create the aggregate environment data 122. From operation 604, the routine 600 continues to operation 606, where the network environmental analysis engine 120 determines whether there is an anomaly in the aggregate environment data 122. According to one embodiment, the local environment data 118 is only transmitted to the network environmental analysis engine 120 if there is an anomaly present. In this embodiment, the network environmental analysis engine 120 will find an anomaly. However, in another embodiment, the local environmental analysis engine 110 in the vehicle 102 may transmit all local environment data 118 and leave the analysis of the local environment data 118 to the network environmental analysis engine 120. In this alternative embodiment, the network environmental analysis engine 120 may or may not locate an anomaly.

If the network environmental analysis engine 120 does not detect an anomaly in the aggregate environment data 122, then the routine 600 returns to operation 602 and proceeds as described above. However, if the network environmental analysis engine 120 detects an anomaly in the aggregate environment data 122 at operation 606, then the routine 600 proceeds to operation 608, where the network environmental analysis engine 120 determines whether a threshold has been met. As discussed above, the network environmental analysis engine 120 may only create the notification 124 if a threshold has been met. For example, the network environmental analysis engine 120 may not create and broadcast the notification 124 unless three vehicles 102 have detected the same anomaly at a particular geographic location within a predetermined period of time. If the network environmental analysis engine 120 determines at operation 608 that the threshold has not been met, then the routine 600 returns to operation 602 and proceeds as described above. However, if at operation 608, the network environmental analysis engine 120 determines that the threshold has been met, then the routine 600 proceeds to operation 610, where the network environmental analysis engine 120 creates the appropriate notification 124.

From operation 610, the routine 600 continues to operation 612, where the network environmental analysis engine 120 determines the proper target for the notification 124. As discussed briefly above, the network environmental analysis engine 120 may transmit the notification 124 to all vehicles 102A-102N, to specific vehicles 102, to electronic signs, to the DOT, to one or more radio and/or television stations, and/or to police departments, fire departments, and other emergency agencies. It should be appreciated that any criteria may be used by the network environmental analysis engine 120 to determine the proper target for the notification 124. The proper target may be determined from pre-programmed logic that selects the target according to the location of the environmental condition being reported, the type of environmental condition being reported, the time of day and/or the day of the week, notification service subscriptions, the characteristics of the vehicles 102A-102N in the vicinity of the environmental condition being reported, or a combination thereof. From operation 612, the routine 600 continues to operation 614, where the network environmental analysis engine 120 transmits the notification 124 to the determined notification target. The routine 600 returns to operation 602 and proceeds as described above.

Figure 7:
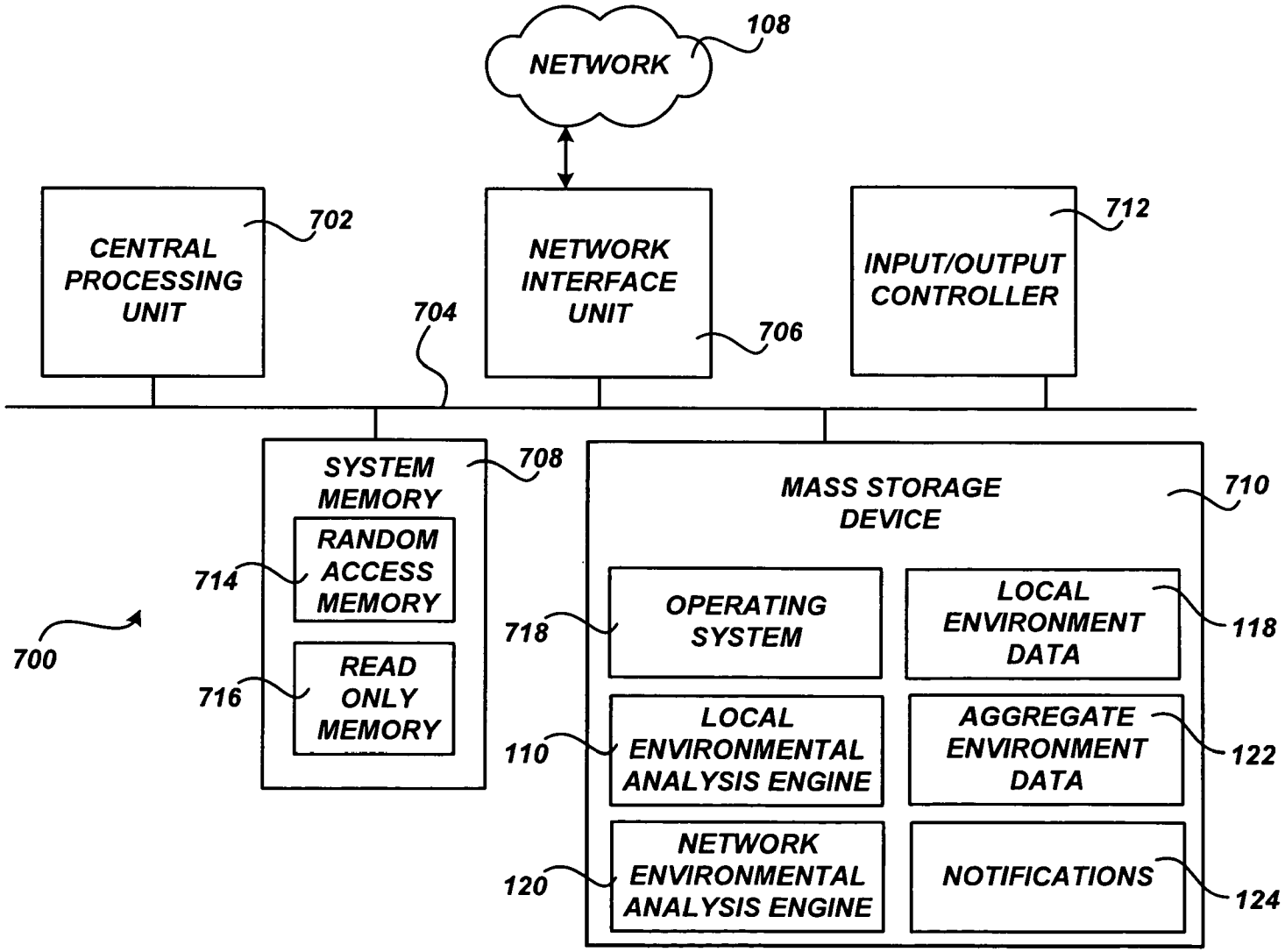
FIG. 7 is a computer architecture diagram showing a computer architecture suitable for implementing the various computer systems described herein.

Referring now to FIG. 7, an illustrative computer architecture for a computer 700 utilized in the various embodiments presented herein will be discussed. The computer architecture shown in FIG. 7 illustrates a conventional desktop, laptop computer, or server computer. Specifically, the computer 700 illustrates the computer architecture associated with the vehicle 102 or the environmental notification server 104. The computer architecture shown in FIG. 7 includes a central processing unit 702 (CPU), a system memory 708, including a random access memory 714 (RAM) and a read-only memory (ROM) 716, and a system bus 704 that couples the memory to the CPU 702. A basic input/output system (BIOS) containing the basic routines that help to transfer information between elements within the computer 700, such as during startup, is stored in the ROM 716. The computer 700 further includes a mass storage device 710 for storing an operating system 718, application programs, and other program modules, which will be described in greater detail below.

The mass storage device 710 is connected to the CPU 702 through a mass storage controller (not shown) connected to the bus 704. The mass storage device 710 and its associated computer-readable media provide non-volatile storage for the computer 700. Although the description of computer-readable media contained herein refers to a mass storage device, such as a hard disk or CD-ROM drive, it should be appreciated by those skilled in the art that computer-readable media can be any available media that can be accessed by the computer 700.

By way of example, and not limitation, computer-readable media may include volatile and non-volatile, removable and non-removable media implemented in any method or technology for storage of information such as computer-readable instructions, data structures, program modules or other data. For example, computer-readable media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium which can be used to store the desired information and which can be accessed by the computer 700.

According to various embodiments, the computer 700 may operate in a networked environment using logical connections to remote computers through the network 108. As described above with respect to FIG. 1, the network 108 may include a wireless network such as, but not limited to, a WLAN such as a WI-FI network, a WWAN, a WPAN such as BLUETOOTH, a WMAN such a WiMAX network, a cellular network, or a satellite network. The computer 700 may connect to the network 108 through a network interface unit 706 connected to the bus 704. It should be appreciated that the network interface unit 706 may also be utilized to connect to other types of networks and remote computer systems. The computer 700 may also include an input/output controller 712 for receiving and processing input from a number of other devices, including a keyboard, mouse, or electronic stylus (not shown in FIG. 7). Similarly, an input/output controller may provide output to a display screen, a printer, or other type of output device (also not shown in FIG. 7).

As mentioned briefly above, a number of program modules and data files may be stored in the mass storage device 710 and RAM 714 of the vehicle 102 or the environmental notification server 104, including the operating system 718 suitable for controlling the operation of a networked desktop or server computer, such as the WINDOWS XP or WINDOWS VISTA operating systems from MICROSOFT CORPORATION of Redmond, Wash. Other operating systems, such as the LINUX operating system or the OSX operating system from APPLE COMPUTER, INC. may be utilized. It should be appreciated that the implementations presented herein may be embodied using a desktop or laptop computer or any other computing devices or systems or combinations thereof.

The mass storage device 710 and RAM 714 may also store one or more program modules. In particular, the mass storage device 710 and the RAM 714 may store the local environmental analysis engine 110, the network environmental analysis engine 120, the local environment data 118, the aggregate environment data 122, and the notifications 124, as well as any other program modules described above with respect to FIG. 1. Based on the foregoing, it should be appreciated that apparatus, systems, methods, and computer-readable media for providing environmental condition notifications are provided herein. Although the subject matter presented herein has been described in language specific to computer structural features, methodological acts, and computer readable media, it is to be understood that the invention defined in the appended claims is not necessarily limited to the specific features, acts, or media described herein. Rather, the specific features, acts and mediums are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A method for providing a notification of an environmental condition, comprising:

collecting vehicle data corresponding to a first vehicle from a vehicle sensor of the first vehicle operative to monitor a system of the first vehicle and collecting environment data from an environment sensor of the first vehicle operative to measure an atmospheric characteristic;

combining the vehicle data and the environment data to create local environment data associated with the first vehicle;

analyzing the local environment data to determine whether an anomaly exists in the local environment data indicating that an environmental condition exists at a geographic location of the first vehicle;

creating the notification comprising the geographic location of the environmental condition; and providing the notification to at least a second vehicle.

2. The method of claim 1, wherein creating the notification comprising the geographic location of the environmental condition comprises:

determining whether the anomaly satisfies a threshold for creating the notification, and creating the notification only if the anomaly satisfies the threshold.

3. The method of claim 2, wherein the threshold comprises a pre-determined minimum number of similar anomalies within a pre-determined distance from the geographic location of the first vehicle.

4. The method of claim 1, wherein the environmental condition comprises a driving hazard.

5. The method of claim 1, wherein collecting vehicle data corresponding to a first vehicle from a vehicle sensor of the first vehicle operative to monitor a system of the first vehicle and collecting environment data from an environment sensor of the first vehicle operative to measure an atmospheric characteristic comprise receiving the vehicle data and the environment data from the first vehicle via a wireless network.

6. The method of claim 5, wherein the wireless network comprises a cellular telecommunications network.

7. The method of claim 1, wherein collecting vehicle comprises vehicle data corresponding to a first vehicle from a vehicle sensor of the first vehicle operative to monitor a system of the first vehicle and collecting environment data from an environment sensor of the first vehicle operative to measure an atmospheric characteristic comprise receiving the vehicle data and the environment data at a local environmental analysis engine residing within the first vehicle, and wherein providing the notification to at least the second vehicle comprises broadcasting the notification over a short-range wireless network.

8. The method of claim 1, wherein providing the notification to at least the second vehicle comprises transmitting the notification to a plurality of vehicles within a pre-determined distance from the geographic location of the first vehicle.

9. A computer-readable medium having computer-executable instructions stored thereon which, when executed by a computer, cause the computer to:

collect vehicle data corresponding to a first vehicle a first vehicle from a vehicle sensor of the first vehicle operative to monitor a system of the first vehicle and collect environment data from an environment sensor of the first vehicle operative to measure an atmospheric characteristic;

combine the vehicle data and the environment data to create local environment data associated with the first vehicle;

analyze the local environment data to determine whether an anomaly exists in the local environment data indicating that an environmental condition exists at a geographic location of the first vehicle create a notification comprising the geographic location of the environmental condition; and provide the notification to at least a second vehicle.

10. The computer-readable medium of claim 9, wherein causing the computer to create the notification comprising the geographic location of the environmental condition comprises causing the computer to:

determine whether the anomaly satisfies a threshold for creating the notification; and create the notification only if the anomaly satisfies the threshold.

11. The computer-readable medium of claim 10, wherein the threshold comprises a pre-determined minimum number of similar anomalies within a pre-determined distance from the geographic location of the first vehicle.

12. The computer-readable medium of claim 9, wherein causing the computer to collect vehicle data corresponding to a first vehicle from a vehicle sensor of the first vehicle operative to monitor a system of the first vehicle and collecting environment data from an environment sensor of the first vehicle operative to measure an atmospheric characteristic comprise causing the computer to receive the vehicle data and the environment data from the first vehicle via a cellular telecommunications network.

13. The computer-readable medium of claim 9, wherein causing the computer to collect vehicle data corresponding to a first vehicle from a vehicle sensor of the first vehicle operative to monitor a system of the first vehicle and collecting environment data from an environment sensor of the first vehicle operative to measure an atmospheric characteristic comprise causing the computer to receive the vehicle data and the environment data at a local environmental analysis engine residing within the first vehicle, and wherein causing the computer to provide the notification to at least the second vehicle comprises causing the computer to broadcast the notification over a short-range wireless network.

14. A system for providing a notification of an environmental condition, comprising:

memory for storing a program containing code for providing notification of an environmental condition; and a processor functionally coupled to the memory, the processor being responsive to computer-executable instructions contained in the program and configured to:

collect vehicle data corresponding to a first vehicle from a vehicle sensor of the first vehicle operative to monitor a system of the first vehicle and collect environment data from an environment sensor of the first vehicle operative to measure an atmospheric characteristic, combine the vehicle data and the environment data to create local environment data associated with the first vehicle, analyze the local environment data to determine whether an anomaly exists in the local environment data indicating that an environmental condition exists at a geographic location of the first vehicle, create the notification comprising the geographic location of the environmental condition, and provide the notification to at least a second vehicle.

15. The system of claim 14, wherein the processor is further configured to determine whether the anomaly satisfies a threshold for creating the notification and to create the notification only if the anomaly satisfies the threshold.

* * * * *